US010946260B1

(12) United States Patent
Ludovici

(10) Patent No.: US 10,946,260 B1
(45) Date of Patent: Mar. 16, 2021

(54) SPORTING APPARATUS TRAINING AID

(71) Applicant: Anthony John Ludovici, Deerfield Beach, FL (US)

(72) Inventor: Anthony John Ludovici, Deerfield Beach, FL (US)

( * ) Notice: Subject to any disclaimer, the term of this patent is extended or adjusted under 35 U.S.C. 154(b) by 0 days.

(21) Appl. No.: 16/816,970

(22) Filed: Mar. 12, 2020

(51) Int. Cl.

| | |
|---|---|
| ***A63B 69/36*** | (2006.01) |
| ***A63B 69/00*** | (2006.01) |
| ***A63B 69/38*** | (2006.01) |
| *A63B 102/18* | (2015.01) |
| *A63B 102/02* | (2015.01) |

(52) U.S. Cl.
CPC ..... *A63B 69/0002* (2013.01); *A63B 69/38* (2013.01); *A63B 2069/0008* (2013.01); *A63B 2102/02* (2015.10); *A63B 2102/182* (2015.10)

(58) Field of Classification Search
CPC ..... A63B 69/0002; A63B 69/38; A63B 2102/182; A63B 2102/02; A63B 2069/0008
See application file for complete search history.

(56) References Cited

U.S. PATENT DOCUMENTS

| | | | | |
|---|---|---|---|---|
| 3,809,397 | A | 5/1974 | Gruenewald | |
| 4,416,451 | A * | 11/1983 | Solloway | A63B 21/00061 482/111 |
| 4,907,800 | A | 3/1990 | Passamaneck et al. | |
| 5,058,890 | A | 10/1991 | Szabo | |
| 5,186,699 | A | 2/1993 | Dimmig | |
| 5,207,625 | A | 5/1993 | White | |
| 5,310,188 | A * | 5/1994 | Hernberg | A63B 69/3632 473/206 |
| 5,395,107 | A * | 3/1995 | De Pippo | A63B 21/0088 473/228 |
| 5,415,406 | A | 5/1995 | Reichenbach et al. | |
| 5,571,048 | A | 11/1996 | Kenney | |
| 6,238,299 | B1 * | 5/2001 | Barnette | A63B 69/3632 473/228 |
| 6,866,592 | B1 | 3/2005 | Gitre | |
| 7,118,490 | B2 * | 10/2006 | Namba | A63B 21/0088 473/228 |
| 7,458,900 | B1 * | 12/2008 | Park | A63B 21/0088 473/226 |
| 7,993,220 | B2 * | 8/2011 | Enday | A63B 69/38 473/463 |
| 8,998,740 | B2 * | 4/2015 | Corcoran | A63B 60/48 473/228 |
| 9,259,636 | B1 | 2/2016 | Bailey | |
| 9,539,482 | B2 | 1/2017 | Parnell | |
| 10,426,988 | B1 * | 10/2019 | Davies | A63B 15/00 |
| 2003/0207719 | A1 * | 11/2003 | Hughes | A63B 15/00 473/228 |
| 2011/0160004 | A1 * | 6/2011 | Imatoh | A63B 21/0088 473/422 |

* cited by examiner

*Primary Examiner* — Nini F Legesse
(74) *Attorney, Agent, or Firm* — Mark C. Johnson; Johnson Dalal

(57) ABSTRACT

A sporting apparatus training aid having a central wall with an inner surface, an outer surface opposing the inner surface of the cylindrical central wall, and with one or more plate-like side fin(s) radially extending outwardly from the outer surface of the central wall, the training aid also having a plate-like base fin coupled to the side fin(s) at an angle to create air resistance thereon and in multiple directions when a sporting apparatus and the training aid are swung together.

20 Claims, 8 Drawing Sheets

SPORTING APPARATUS TRAINING AID

FIELD OF THE INVENTION

The present invention relates generally to training devices or aids, and, more particularly, relates to training devices or aids directed toward the sporting equipment, namely baseball and softball bats, golf clubs, tennis rackets, and other sporting apparatuses involving a swinging motion or other impetus.

BACKGROUND OF THE INVENTION

Many sports employ tools used to strike a ball, such as baseball and softball bats, golf clubs, tennis rackets, etc. (hereinafter "sporting apparatuses"). Participants in such sports desire to swing the sporting apparatuses quicker to generate a greater torque or speed of the sporting apparatuses. A faster swing speed equates to greater power imparted to the struck ball, a characteristic desired in all sports. The key to training to increase swing speed is to employ a training device that imparts continuous resistance opposite, and only opposite, the direction of the sporting apparatuses, throughout the entire swing. Since a sporting apparatus moves in a very dynamic, multi-planar, multi-axial curvilinear path, an optimal training aid has been elusive thus far.

Many devices and methods have been employed in an attempt to train sporting participants to increase their swing speed. One known method to effectuate the same includes adding one or more selectively removable weight(s) to the sporting apparatuses. However, these weights to do not effectively and efficiently train the user. Specifically, the force generated by the one or more weight(s) is primarily or partially in the downward direction due to gravity. Numerous scientific studies have definitively proven that adding weight(s) to the barrel of a bat (or other swinging apparatus) is detrimental to swing mechanics and results in adverse swing training leading to a slower swing speed. One or more weight(s) attached to a sporting apparatus that is operable to be swung results in two forces. First, like all objects with mass, the force acting upon a weight is in the downward direction, due to the force of gravity. The one or more weight(s) make the sporting apparatuses feel heavier to pick up and hold, but they do not provide any resistance opposite the path of the sporting apparatus's contact surface (bat barrel, club head, racket face, etc.). In addition to the force of gravity, a weight attached to a swinging bat experiences centrifugal force. This force acts along the axis of the swung device. The centrifugal force gives the swinger the feeling that the bat (or other apparatus) is being pulled away, and the swinger needs to tighten their grip by engaging their hand and forearm muscles. Note the only two forces in play when a weight is added to a swung device, i.e., gravity—a downward force—and centrifugal force—a force along the shaft in a direction away from the swinger. Both forces are counter-productive if the objective is to create forces opposite to the path of the striking area (bat barrel, club head, racket head, etc.). Furthermore, once the swing has begun and the sporting apparatus is in motion, Newton's First Law of Physics, sometimes called the Law of Inertia, applies: An object in motion remains in motion unless acted upon by an external force. An attached weight creates little to no air resistance. Once it initially starts in motion, momentum continues it in motion. It requires little to no effort to continue the weight's movement. This is why training with an attached weight does not increase bat speed or power.

Attaching one or more weight(s) is also detrimental to proper swing mechanics. Training with attached weight(s) has been scientifically proven to not only slow swing speed, but will also improperly train muscles not required for optimal swing mechanics and can potentially lead to injuries to the swinger.

Therefore, a device is needed that creates drag throughout the entire swing, from the start to follow-through; will require constant effort to continue the swing motion; accurately replicates the desired swing mechanics; and will thus increase strength, power, and swing speed.

In theory, using drag, or air resistance, is an effective means to create forces opposite the direction of the path of the sporting apparatuses' contact surface (bat barrel, club head, racket face, etc.). The problem with all known devices and methods employing "fin(s)" is the mechanics of the swing in each sport does not allow air resistance to build. All swings are initiated with a pulling of the hands towards the target, followed by an aggressive rotation of the sporting apparatuses to generate maximum speed of the contact surface upon striking the ball.

Fin effectiveness is maximized when the fin angle is incident (approximately 90°) to the relative airflow. This only occurs at the point of contact. Up until contact, the bat barrel path is a very dynamic combination of axial rotation and curvilinear motion. Early in the swing, when the hands are pulling the sporting apparatus towards the target, the contact surface and thus the fins, are oriented longitudinally with the relative wind. The fins are creating zero drag. As the contact surface starts to rotate forward, the fins begin to orient into the relative wind, and some drag effects begin. The problem, however, is that at shallow angles relative to the air, the air basically "slides" along the longitudinal fins and off the back end of the longitudinal fins. As the swing progresses, the angle of the fins to the relative wind increases until it reaches its maximum of approximately 90° at the point of contact. However, until approximately 90°, air continuously "slides" off the fins and the air resistance never comes close to achieving its maximum potential.

Some known devices have also been developed to utilize air resistance when swinging the sporting apparatuses to aid in training the user to swing the sporting apparatus more quickly. Some of these devices, like those described in U.S. Pat. No. 3,809,397 (Gruenewald), U.S. Pat. No. 5,310,188 (Hernberg), U.S. Pat. No. 5,415,406 (Reichenbach et al.), and U.S. Pat. No. 7,118,490 (Namba) fail to provide adequate resistance for the user and/or fail to sufficiently couple to the sporting apparatus, deeming them largely ineffective and inefficient in training to increase swing speed.

Therefore, a need exists to overcome the problems with the prior art as discussed above.

SUMMARY OF THE INVENTION

The invention provides a sporting apparatus training aid that overcomes the hereinafore-mentioned disadvantages of the heretofore-known devices and methods of this general type and that effectively and efficiently couples to a sporting apparatus and generates air resistance when swinging the sporting apparatus in order to condition the user to swing the apparatus faster, and without jeopardizing the motion of the swing.

Said another way, the known devices and methods employing a fin design are improved on by beneficially utilizing a base (or end) fin. The missing component of all previous art that limits their effectiveness is the addition of a base (end) fin. This addition single handedly resolves all the pitfalls and drawbacks of a training apparatus that only incorporate longitudinally oriented fins. As stated above, the key to increasing drag is to not allow the air to "slide" off the end of the longitudinal fins by utilizing end or base fins to "contain" the air. The end fin connects to the end of the longitudinal fin(s), meets the sporting apparatus at its circumference or center, and is angled away from of outer surface the sporting apparatus.

A device with both longitudinal and end fins is vastly more effective at creating resistance forces throughout the entire dynamic swing. Furthermore, the force is only in a direction opposite the path of the sporting apparatus' contact surface. The resistance force is also directly related to the speed of the swing. The faster the swing, the greater the resistance force. This makes the same device an effective training tool for a strong expert, a weak novice, and all combinations in between. The difference between a device with only longitudinal fins and one with longitudinal fins combined with base fins is astounding. The resistance and training effectiveness are dramatically increased by adding the base fins. With a combination of longitudinal and base fins, the swinger must continuously apply effort throughout the entire swing motion to offset the drag forces. Unlike an apparatus that is swung with an attached weight, the user swinging a device employing longitudinal and base fins is not assisted by momentum and must therefore provide all the force required to swing the sporting apparatus.

The approach of combining longitudinal fins with base fins is not limited to a cylindrical configuration as applied to baseball or softball bats, golf clubs, etc. By flattening out the cylinder into a plane and orienting the combined fins on a planar surface, the same aerodynamic concepts result in identical benefits and advantages for a device mounted on a racket face. Whether the fins are mounted on a hollowed cylindrical tubular body (baseball bat, golf club, etc.) or on a planar surface (tennis racket, badminton racket, squash racket, etc.), the principles, science, and benefits are identical. Both orientations result in greater drag and an optimal swing speed training device.

Although the invention is illustrated and described herein as embodied in a sporting apparatus training aid, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

With the foregoing and other objects in view, there is provided, in accordance with the invention, a sporting apparatus training aid having a unitary and portable body having a proximal end defining an enclosed proximal opening, a distal end opposing the proximal end and defining an enclosed distal opening. The body includes a body length separating the proximal and distal ends, may have a cylindrical central wall having an inner surface, an outer surface opposing the inner surface of the cylindrical central wall, having a plurality of plate-like side fins radially extending outwardly from the outer surface of the cylindrical central wall and disposed at approximately 90° with respect to one another, and having a plate-like base fin defining the distal end of the body, interposed between each of the plurality of plate-like side fins.

In accordance with a further feature of the present invention, each of the plurality of plate-like side fins are of uniform thickness of approximately 2-10 mm and span at least 70% of the body length.

In accordance with yet another feature of the present invention, the cylindrical central wall of the body defines a central placement channel separating the enclosed proximal opening and the enclosed distal opening.

In accordance with a further feature of the present invention, the central placement channel tapers in diameter from the enclosed distal opening to the enclosed proximal opening.

In accordance with another feature, an embodiment of the present invention includes the plate-like base fin having an upper surface and a lower surface opposing the upper surface of the plate-like base fin, wherein the upper surface of the plate-like base fin is disposed at an obtuse angle with respect to the outer surface of the cylindrical central wall.

In accordance with an additional feature of the present invention, the lower surface of the plate-like base fin defines a recessed cavity disposed at the distal end of the body.

In accordance with yet another feature of the present invention, the plurality of plate-like side fins are disposed at equi-distance radial angles to one another and section the plate-like base fin into equal sections and the cylindrical central wall extends outwardly passed the lower surface of the plate-like base fin and defines a terminal distal end of the body.

Also in accordance with present invention, a sporting apparatus training aid is disclosed that includes a unitary and portable body having a proximal end defining an enclosed proximal opening, a distal end opposing the proximal end and defining an enclosed distal opening, a body length separating the proximal and distal ends, and a central wall having an inner surface and an outer surface opposing the inner surface of the central wall. The body also includes a plurality of plate-like side fins radially extending outwardly from the outer surface of the central wall and disposed at approximately 90° with respect to one another, and has a plate-like base fin defining the distal end of the body, interposed between each of the plurality of plate-like side fins.

In accordance with another feature, an embodiment of the present invention also includes the plate-like base fin having an upper surface and a lower surface opposing the upper surface of the plate-like base fin, wherein the upper surface of the plate-like base fin is disposed at an obtuse angle with respect to the outer surface of a cylindrical central wall.

In accordance with another feature, a further embodiment of the present invention also includes a proximal end on each of the plurality of plate-like side fins, a distal end on each of the plurality of plate-like side fins opposite the proximal end on the plate-like side fin, and opposing side surfaces on each of the plurality of plate-like side fins each respectively defining an outer side-fin plane. The body may include a lower surface on the plate-like base fin defining the distal end of the body and an upper surface on the plate-like base fin opposite the lower surface of the plate-like base fin, wherein the upper surface of the plate-like base fin having the distal end of each of the plurality of plate-like side fins directly coupled thereto and oriented at an angled configuration ranging approximately 5-175° with respect to the outer surface of central wall.

In another embodiment of the present invention a unitary and portable body is selectively removably coupled to a sporting apparatus and having a proximal end, a distal end opposing the proximal end, a body length separating the proximal and distal ends, a central wall having an inner surface, an outer surface opposing the inner surface of the central wall, having at least one plate-like side fin radially extending outwardly from the outer surface of the central wall, with a proximal end, a distal end opposite the proximal end of the at least one plate-like side fin, and opposing side surfaces defining outer side-fin planes oriented in the shaft direction. The body has a plate-like base fin with a lower surface defining the distal end of the body and an upper surface opposite the lower surface of the plate-like base fin, wherein the upper surface of the plate-like base fin has the distal end of the at least one plate-like side fin directly coupled thereto and oriented at an angled configuration ranging approximately 5-175° with respect to the outer surface of central wall.

In accordance with yet another feature of the present invention, the upper surface of the plate-like base fin defines a base-fin plane traversing each of the outer side-fin planes, the upper surface of the plate-like base fin extending a length from the outer surface of central wall at least substantially equal to a radial length of the at least one plate-like side fin. Additionally, the upper surface of the plate-like base fin may be oriented at an angled configuration ranging approximately 60-120° with respect to the outer surface of central wall.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time. Also, for purposes of description herein, the terms "upper", "lower", "left," "rear," "right," "front," "vertical," "horizontal," and derivatives thereof relate to the invention as oriented in the figures and is not to be construed as limiting any feature to be a particular orientation, as said orientation may be changed based on the user's perspective of the device. Furthermore, there is no intention to be bound by any expressed or implied theory presented in the preceding technical field, background, brief summary or the following detailed description.

As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. In this document, the term "longitudinal" should be understood to mean in a direction corresponding to an elongated direction of the apparatuses utilized with the training aid, namely from the first end of the apparatus to the second end of the apparatus.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

DETAILED DESCRIPTION

Figure 2:
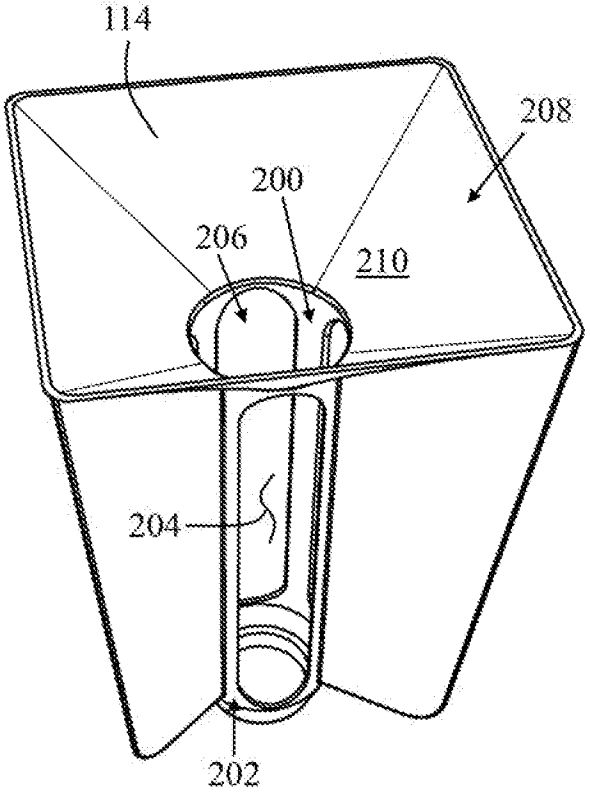
FIG. 2 is an upward-looking perspective view of the sporting apparatus training aid in FIG. 1.

While the specification concludes with claims defining the features of the invention that are regarded as novel, it is believed that the invention will be better understood from a consideration of the following description in conjunction with the drawing figures, in which like reference numerals are carried forward. It is to be understood that the disclosed embodiments are merely exemplary of the invention, which can be embodied in various forms.

With reference to FIGS. 1-5, the present invention provides a novel and efficient sporting apparatus training aid 100 structurally and operably configured to provide optimal air resistance to a sporting apparatus, e.g., a baseball bat, tennis racket, golf club, hockey stick, etc., opposite to the swinging path of the sporting apparatus when the training aid 100 is coupled thereto. As seen in the figures, the structural configuration of a plurality of fins 112*a-n* facilitates in sufficiently creating the air resistance. The faster the sporting apparatus is swung, the greater resistance force is created, i.e., the speed of the sporting apparatus is proportional to the air resistance force on the sporting apparatus. Additionally, the sporting apparatus training aid 100 reinforces the proper swing mechanics for a sporting apparatus, in addition to training and strengthening the entire kinetic chain to derive power and head speed for the sporting apparatus.

Figure 1:
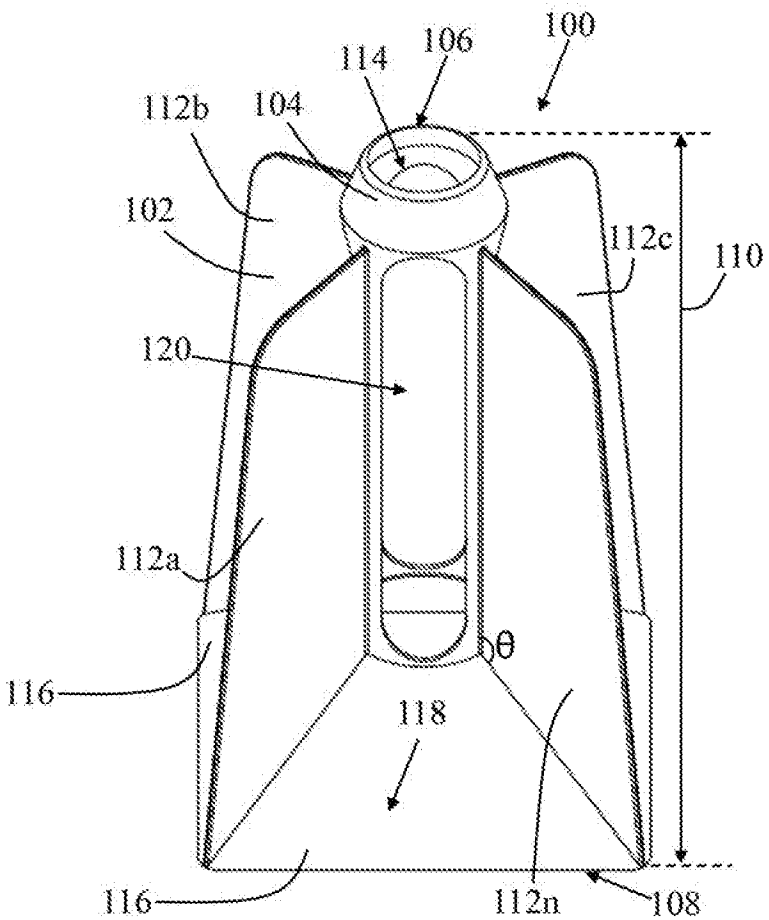
FIG. 1 is a downward-looking perspective view of a sporting apparatus training aid in accordance with one embodiment of the present invention.
Figure 3:
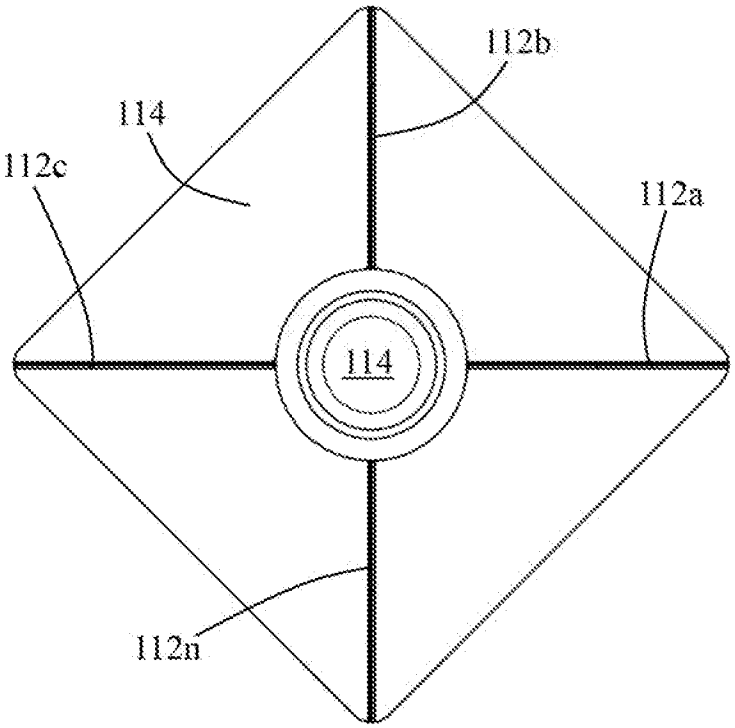
FIG. 3 is a top plan view of the sporting apparatus training aid in FIG. 1.
Figure 5:
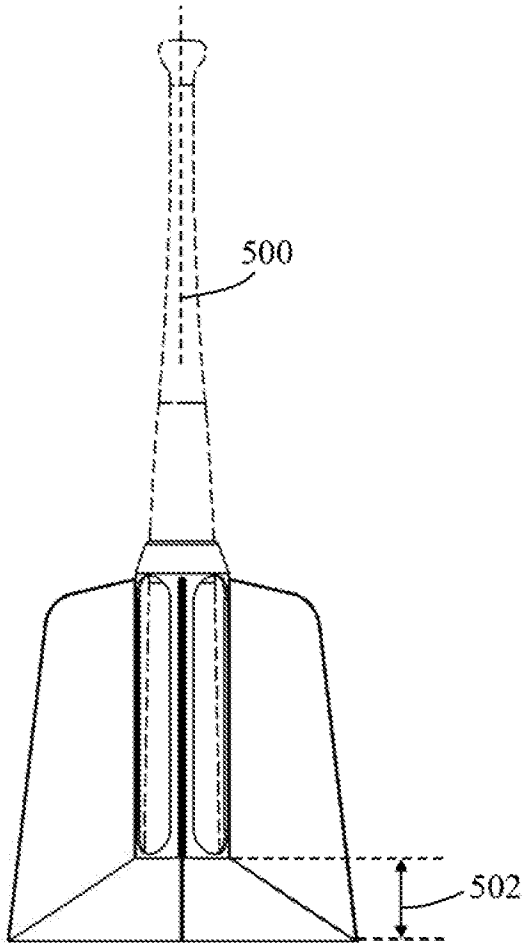
FIG. 5 is an elevational side view of the sporting apparatus training aid in FIG. 4.
Figure 4:
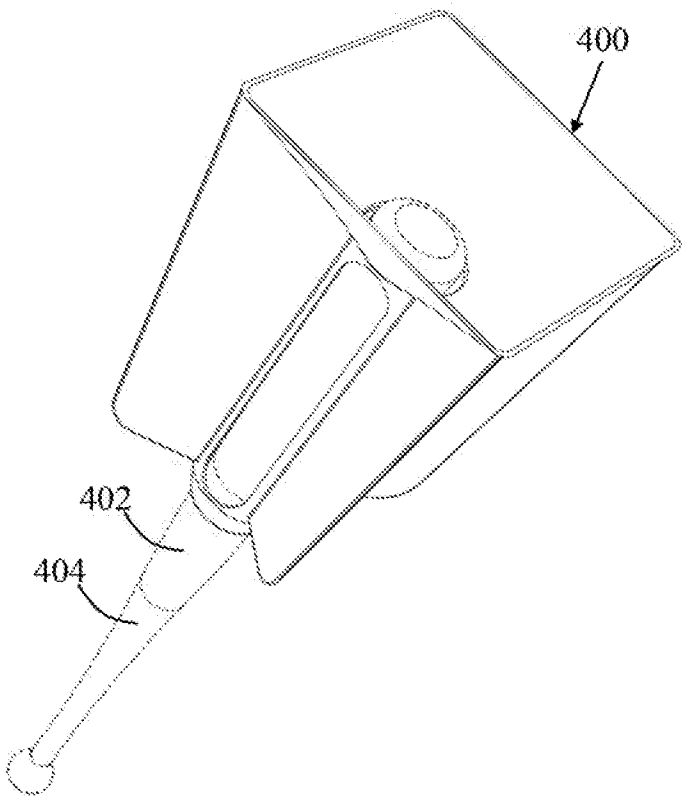
FIG. 4 is an upward-looking perspective view of the sporting apparatus training aid in FIG. 1 attached to a baseball bat in accordance with one embodiment of the present invention.
Figure 6:
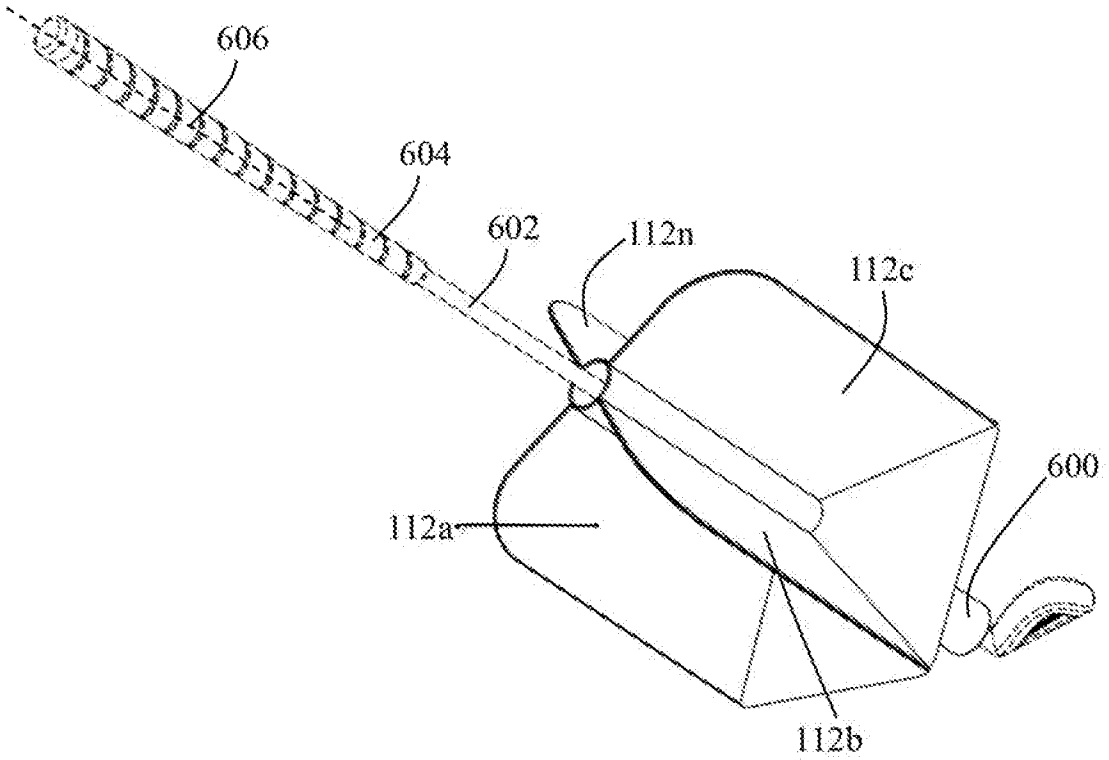
FIG. 6 is a downward-looking perspective view of a sporting apparatus training aid attached to a golf club in accordance with one embodiment of the present invention.
Figure 9:
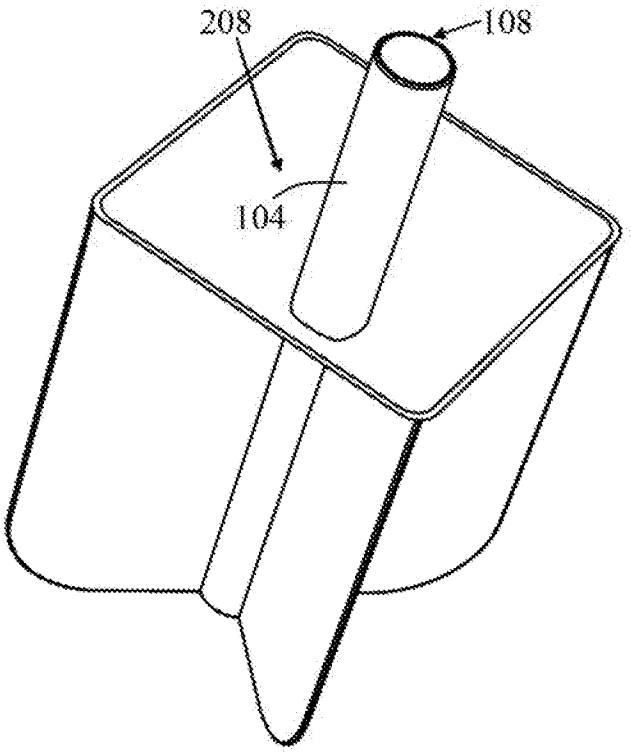
FIG. 9 is an upward-looking perspective view of the sporting apparatus training aid in FIG. 6.
Figure 8:
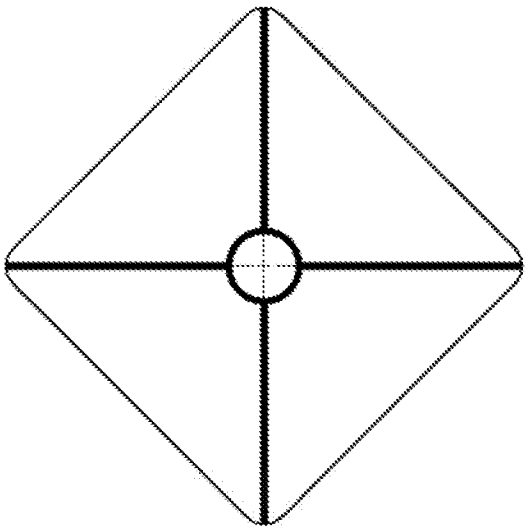
FIG. 8 is a top plan view of the sporting apparatus training aid in FIG. 6.
Figure 7:
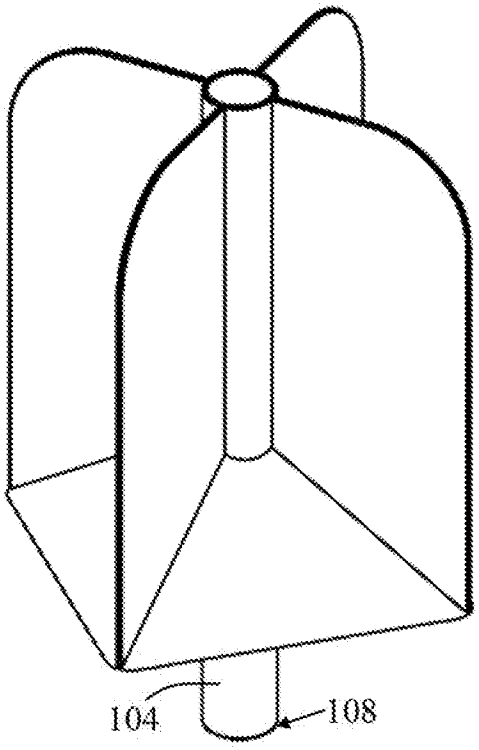
FIG. 7 is a downward-looking perspective view of the sporting apparatus training aid in FIG. 6.

Referring specifically now to FIGS. 1-2, one embodiment of the present invention is shown in perspective views. FIGS. 1-2, along with the other figures herein, shows several advantageous features of the present invention, but, as will be described below, the invention can be provided in several shapes, sizes, combinations of features and components, and varying numbers and functions of the components. The sporting apparatus training aid 100 can be seen having a unitary and portable body 102 with a proximal end 106 defining an enclosed proximal opening 114 and a distal end 108 opposing the proximal end 106 and defining an enclosed distal opening 206 thereon. As depicted in FIGS. 4-6, the proximal and distal openings 114, 206 enable quick and efficient entry and egress of various sporting apparatuses having an elongated shaft, e.g., golf clubs, baseball bats, etc. with two opposing terminal ends.

The body 102 is unitary in that it is operable to move as one unit, e.g., the individual pieces are molded together or joined together to move as a unit. The body 102 portable in that it is movable by a user without the need for any ancillary equipment or machinery. The body 102 is also preferably lightweight, e.g., less than approximately 1.5 lbs. In one embodiment, the body 102 components are of a polymeric material such as ABS plastic or PVC. In other embodiments, the body 102 may be a lightweight metallic material, e.g., aluminum.

The body 102 has a body length 110 separating the proximal and distal ends 106, 108, wherein the body length 110 may be approximately 10-14 inches. In one embodiment, the body 102 may also include cylindrical central wall 104 having an inner surface 200, an outer surface 202 opposing the inner surface 200 of the cylindrical central wall 104. The cylindrical central wall 104 of the body 102 can be seen defining a central placement channel 204 separating the enclosed proximal opening 114 and the enclosed distal opening 206. The central placement channel 204 provides a volume where the elongated shaft of the sporting apparatus is placed. As used herein, the term "wall" is intended broadly to encompass continuous structures, as well as, separate structures that are coupled together so as to form a substantially continuous external surface. However, in one embodiment, the cylindrical central wall 104 may include one or more slots, e.g., slot 120, formed therein. The one or more slots facilitate in reducing the weight of the body 102 and may also facilitate in removal of the elongated shaft.

Figure 10:
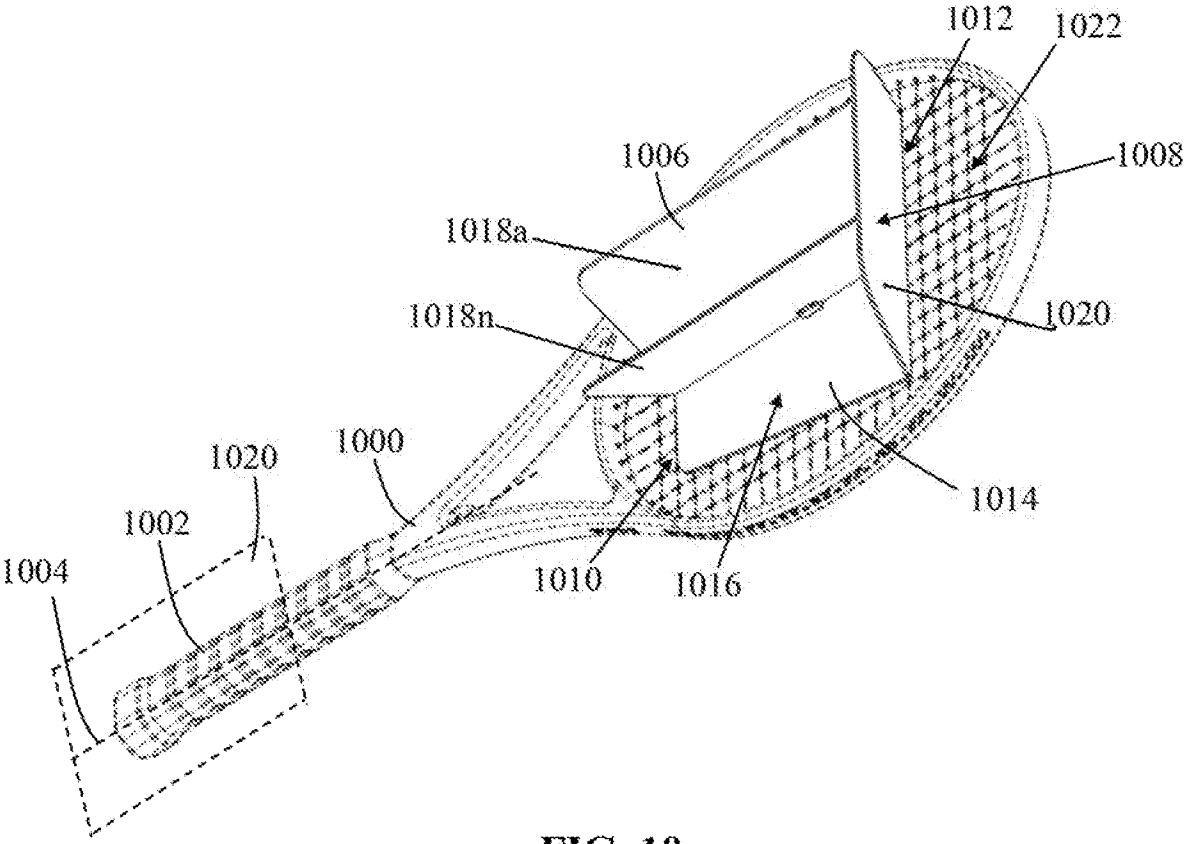
FIG. 10 is a perspective view of a sporting apparatus training aid attached to a tennis racket in accordance with one embodiment of the present invention.
Figure 11:
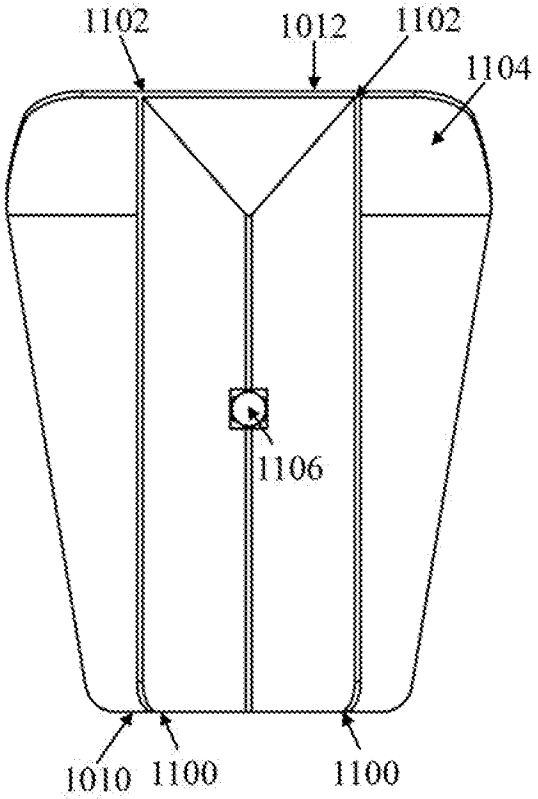
FIG. 11 is an elevational front view of the sporting apparatus training aid in FIG. 10.
Figure 12:
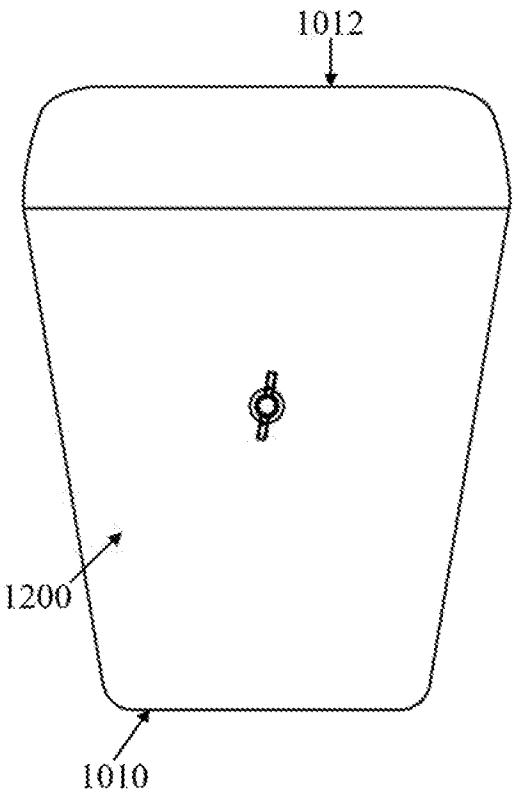
FIG. 12 is an elevational rear view of the sporting apparatus training aid in FIG. 10.
Figure 15:
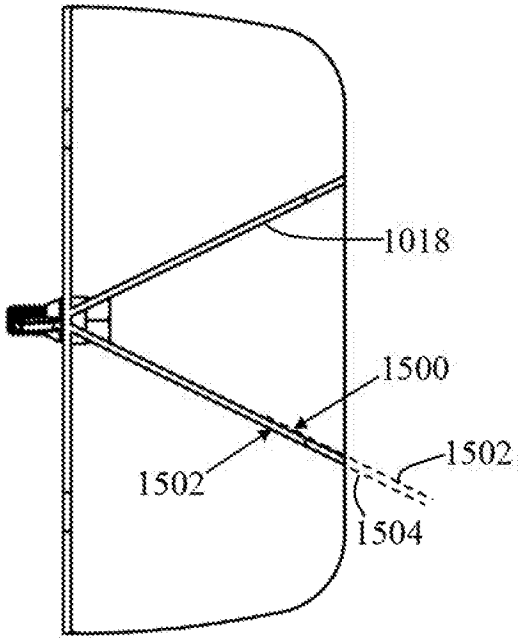
FIG. 15 is a top plan view of the sporting apparatus training aid in FIG. 10.
Figure 14:
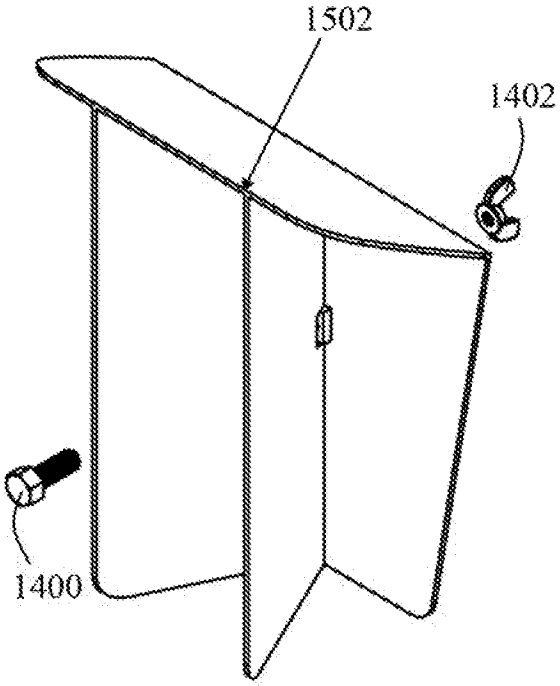
FIG. 14 is a perspective view of the sporting apparatus training aid in FIG. 10.
Figure 13:
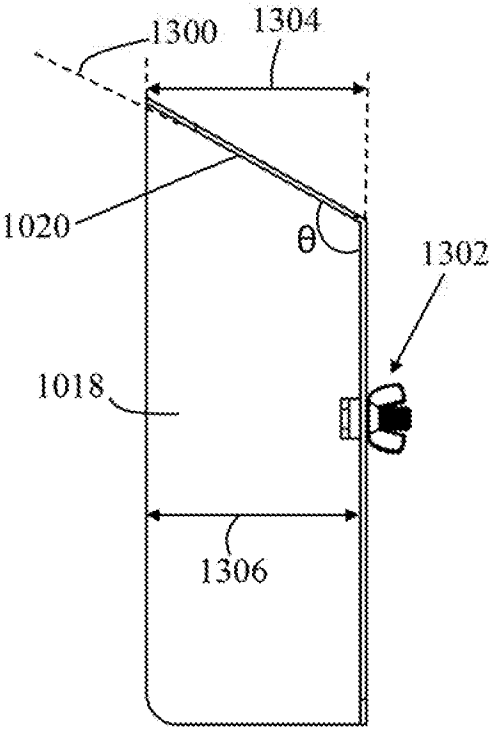
FIG. 13 is an elevational side view of the sporting apparatus training aid in FIG. 10.

When the body 102 is designed to removably couple with an elongated shaft 402, 604 of sporting apparatuses such as a baseball bat or golf club (as depicted in FIGS. 4-6), the proximal and distal openings 114, 206, which are defined by the proximal and distal ends 106, 108, respectively, are sized to completely or partially receive the length of shafts 402, 604. And while FIG. 10 depicts the body 102 selectively removably coupled to the utilization surface 1022 of a tennis racket 1000, as opposed to the shaft 1002, other embodiments of the body 102 may also include sizing of the openings 114, 206 to receive the shaft 1002 of the tennis racket 1000. In one embodiment, the central wall 104 of the body 102 defines a central placement channel 204 separating the enclosed proximal and distal openings 114, 206. In one embodiment, the central placement channel 204 tapers in diameter from the enclosed distal opening 206 to the enclosed proximal opening 114, thereby providing a tighter fit for the shaft of the sporting apparatus. In other embodiments, the enclosed proximal opening 114 may be of a small diameter than the enclosed distal opening 206, while the central placement channel 204 may of a tapered or uniform diameter. In yet other embodiments of the present invention, the ends 106, 108 of the body 102 defining the proximal and distal openings 114, 206 may include a rubber gasket or other polymeric and/or friction-inducing material facilitating in retaining the sporting apparatuses therein while in use. Said another way, in addition to the centrifugal force and sizing of the ends 106, 108, the friction-inducing material may also facilitate in retaining the sporting apparatuses to the body 102 while in use.

In further embodiments, as depicted in FIGS. 10-15, the body 1006 may be selectively removably coupled to the sporting apparatus 1000 with one or more fastener(s) 1302. The fastener(s) exemplified in FIGS. 10-15 is a bolt 1400 and wing nut 1402. More specifically, the body 1006 includes an aperture 1106 formed on the central wall 1014 and extends therethrough for insertion and removal of the bolt 1400, wherein the nut 1402 is selectively removably coupled to the bolt 1400 to retain the body 1006 to the utilization surface 1022 of the racket 1000. In other embodiments, the body 1006 (regardless the embodiment) may be formed on the sporting apparatus, whereby it is not selectively removable with respect to the sporting apparatus. In said embodiment, the body 1006 would, however, still be considered coupled thereto, portable, and unitary. The sporting apparatus may also be utilized in its conventional manner or just for training purposes.

Referring back to FIGS. 1-2, the central wall 104 also has an inner surface 200, an outer surface 202 opposing the inner surface 200 of the central wall 104, wherein each of the one or more plate-like side fins 112*a-n* radially extend therefrom. In one embodiment, when a plurality of plate-like side fins 112*a-n* are utilized, they may each be disposed at approximately 90° (+1-15°) with respect to one another. In further embodiments, each of the plurality of plate-like side fins 112*a-n* are of uniform thickness of approximately 2-10 mm and span at least 70% of the body length 110 to effectively provide air resistance to the apparatus while in use with the body 102 attached thereto. In preferred embodiments, each of the plurality of plate-like side fins 112*a-n* span approximately the entire body length 110, i.e., within 10% of the overall body length 110. The plurality of plate-like side fins 112*a-n* may also be disposed at equidistant radial angles to one another and may section the plate-like base fin 116 into equal sections, thereby providing greater "capturing" of air at the end of the side fins, regardless of the rotational orientation of the body 102 while on the sporting apparatus.

Advantageously, the body 102 includes the plate-like base fin 116 that defines the distal end 108 of the body 102, wherein the plate-like base fin 116 may be interposed between each of the plurality of plate-like side fins 112*a-n* when more than one plate-like side fin is employed. When a plurality of plate-like side fin(s) 112*a-n* are utilized, the plate-like base fin 116 may be interposed between each of the plurality of plate-like side fins 112*a-n* (wherein "n" represents any number greater than 2). As such, the training aid 100 of the present invention effectively and efficiently provides air resistance at multiple angles and paths of movement for the sporting apparatus. Said another way, the base fin 116 prevents air flowing through the one or more side fins 112*a-n* to simply flow through, thereby providing air resistance to the user along the longitudinal direction of shaft of the sporting apparatus. To effectuate the same, the plate-like base fin 116 includes an upper surface 118 and a lower surface 208 opposing the upper surface 118 of the plate-like base fin 116, wherein the upper surface 118 of the plate-like base fin 116 is oriented at an angled configuration ranging approximately 5-175°, or "θ", with respect to the outer surface 202 of central wall 104. Similarly, and with brief reference to FIG. 10-15, the upper surface 1104 of the plate-like base fin 1020 may also have a distal end 1102 of the one or more plate-like side fin(s) 1018 directly coupled thereto and oriented at an angled configuration ranging approximately 5-175°, or "θ", with respect to the outer surface 1016 of the central wall 1014. In some embodiments, regardless the embodiment of the body 102, the upper surface 118 of the plate-like base fin 116 is disposed at an obtuse angle, e.g., approximately 125° (+/−10°) with respect to the outer surface 202 of the central wall 104. In some embodiments, the slope of the plate-like base fin 116 may be linear, but in other embodiments may be curvilinear. The side fin(s) 112*a-n* and base fin 116 are plate-like in that they are slender in thickness with respect to other dimensions of the structure, i.e., length and/or width.

Still referring to FIGS. 1-2, in combination with FIG. 5, the lower surface 208 of the plate-like base fin 116 may define a recessed cavity 210 disposed at the distal end 108 of the body 102. In one embodiment, the recessed cavity 210 may be approximately 2-3 inches recessed from the terminal end of the body 102. The recessed cavity 210 enables the distal end of sporting apparatus, such as baseball bats, to be completely recessed within the body 102, thereby providing more surface area for air resistance displaced the greatest distance from the handle of the sporting apparatus. In one embodiment, when utilized with a golf club (as depicted in FIGS. 6-9) or a hockey stick, the cylindrical central wall 104 may extend outwardly passed the lower surface 208 of the plate-like base fin 116 and may define a terminal distal end 108 of the body 102.

As best seen in FIGS. 4-6 and FIG. 10, the specific sporting apparatus 402, 602, 1000 includes an elongated shaft 404, 604, 1002 for gripping by a user and defines a longitudinal axis 406, 606, 1004 and a longitudinal plane oriented in a shaft direction and through a centroid on the longitudinal axis. Using FIGS. 10-15 as an example, the one or more plate-like side fin(s) 1018 may have a proximal end 1100, a distal end 1102 opposite the proximal end 1100 of the plate-like side fin 1018, and have opposing side surfaces 1500, 1502 defining outer side-fin planes 1504, 1506 oriented in the shaft direction. The plate-like base fin 1020 also includes a lower surface 1008 defining the distal end 1012 of the body 1006 and an upper surface 1104 opposite the lower surface 1008 of the plate-like base fin 1020, wherein the upper surface 1104 of the plate-like base fin 1020 has the distal end 1102 of the at least one plate-like side fin 1018 directly coupled thereto and oriented at an angled configuration ranging approximately 5-175° with respect to the outer surface 1016 of central wall 1014. In one embodiment, the plate-like base fin 1020 may be selectively adjustable in angle with respect to the outer surface 1016 of the central wall 1014, thereby modulating the volume of captured air or air resistance experienced by the user. To effectuate the same, the plate-like base fin 1020 may be operably configured to rotate with respect to the central wall 1014, e.g., using a hinge. The one or more side fin(s) 1018 may be operably configured to slide with respect to the outer surface 1016 of the central wall 1014, e.g., using a track or tongue-and-groove configuration.

In other embodiments, the upper surface 1104 of the plate-like base fin 1020 is oriented at an angled configuration ranging approximately 60-120° with respect to the outer surface 1016 of central wall 1014 to effectively "capture" incoming air through the side fin(s) 1018*a-n*. Said differently, the upper surface 1104 of the plate-like base fin 1020 may also define a base-fin plane 1300 traversing each of the outer side-fin planes 1504, 1506, wherein the upper surface 1104 of the plate-like base fin 1020 extend a length 1304 from the outer surface 1016 of central wall 1014 at least substantially equal to a radial length, e.g., length 1306, of the at least one plate-like side fin 1018.

As such, to utilize the body 102, the user will selectively removably couple the body 102 the shaft or utilization surface of the sporting apparatus. When utilizing shafts similar to baseball or softball bats, the user will slide the body over the handle portion of the sporting apparatus until it reaches the distal end of the sporting apparatus (shown best in FIG. 4). Then, the user will apply an impetus to the sporting apparatus, thereby generating air resistance when swinging the sporting apparatus in order to condition the user to swing the apparatus faster, and without jeopardizing the motion of the swing. Although a specific order of executing process steps of utilizing the body has been disclosed and can be gleaned from the figures, the order of executing the steps may be changed relative to the order shown in certain embodiments. Also, two or more steps shown in succession may be executed concurrently or with partial concurrence in some embodiments. Certain steps may also be omitted for the sake of brevity. In some embodiments, some or all of the process steps included can be combined into a single process.

Various modifications and additions can be made to the exemplary embodiments discussed without departing from the scope of the present disclosure. For example, while the embodiments described above refer to particular features, the scope of this disclosure also includes embodiments having different combinations of features and embodiments that do not include all of the above described features.

What is claimed is:

1. A sporting apparatus training aid comprising:

a unitary and portable body having a proximal end defining an enclosed proximal opening, a distal end opposing the proximal end and defining an enclosed distal opening, a body length separating the proximal and distal ends, a cylindrical central wall having an inner surface, an outer surface opposing the inner surface of the cylindrical central wall, having a plurality of plate-like side fins radially extending outwardly from the outer surface of the cylindrical central wall, and having a plate-like base fin with an upper surface disposed at an obtuse angle with respect to the outer surface of the cylindrical central wall and defining the distal end of the body, interposed between each of the plurality of plate-like side fins, the plurality of plate-like side fins and the plate-like base fin each having a length and a width greater than a thickness of said plurality of plate-like side fins and plate-like base fin.

2. The sporting apparatus training aid according to claim 1, wherein:

each of the plurality of plate-like side fins are of uniform thickness of approximately 2-10 mm and are disposed at approximately 90° with respect to one another.

3. The sporting apparatus training aid according to claim 1, wherein:

each of the plurality of plate-like side fins span at least 70% of the body length.

4. The spoiling apparatus training aid according to claim 1, wherein:

the cylindrical central wall of the body defines a central placement channel separating the enclosed proximal opening and the enclosed distal opening.

5. The sporting apparatus training aid according to claim 4, wherein:

the central placement channel tapers in diameter from the enclosed distal opening to the enclosed proximal opening.

6. The sporting apparatus training aid according to claim 1, wherein:

the lower surface of the plate-like base fin defines a recessed cavity disposed at the distal end of die body.

7. The sporting apparatus training aid according to claim 1, wherein:

the plurality of plate-like side fins are disposed at equi-distant radial angles to one another and section the plate-like base fin into equal sections.

8. The sporting apparatus training aid according to claim 1, wherein the cylindrical central wall extends outwardly passed the lower surface of the plate-like base fin and defines a terminal distal end of the body.

9. The sporting apparatus training aid according to claim 1, wherein:

the upper surface of the plate-like base fin extends a length from the outer surface of central wall at least substantially equal to a radial length of the plurality of plate-like side fins.

10. A sporting apparatus training aid comprising:

a unitary and portable body having a proximal end defining an enclosed proximal opening, a distal end opposing the proximal end and defining an enclosed distal opening, a body length separating the proximal and distal ends, an enclosed central wall having an inner surface, an outer surface opposing the inner surface of the central wall, having a plurality of plate-like side fins radially extending outwardly from the outer surface of the central wall, and having a plate-like base fin interposed between each of the plurality of plate-like side fins and having an upper surface and a lower surface opposing the upper surface of the plate-like base fin and disposed at an obtuse angle with respect to the outer surface of the central wall, the plurality of plate-like side fins and the plate-like base fin each having a length and a width greater than a thickness of said plurality of plate-like side fins and plate-like base fin.

11. The sporting apparatus training aid according to claim 10, wherein:

the central wall is cylindrical.

12. The sporting apparatus training aid according to claim 11, wherein:

the plate-like base fin also defining the distal end of the body.

13. The sporting apparatus training aid according to claim 12, wherein:

the lower surface of the plate-like base fin defines a recessed cavity disposed at the distal end of the body and the plurality of plate-like side fins are disposed at equi-distant radial angles and at approximately 90° with respect to one another to one another and section the plate-like base fin into equal sections.

14. The sporting apparatus training aid according to claim 13, wherein the central wall is cylindrical and extends outwardly passed the lower surface of the plate-like base fin and defines a terminal distal end of the body.

15. The sporting apparatus training aid according to claim 10, further comprising:

a proximal end on each of the plurality of plate-like side fins, a distal end on each of the plurality of plate-like side fins opposite the proximal end on the plate-like side fin, and opposing side surfaces on each of the plurality of plate-like side fins each respectively defining an outer side-fin plane;

a lower surface, on the plate-like base fin defining the distal end of the body and the upper surface on the plate-like base fin opposite the lower surface, of the plate-like base fin, the upper surface of the plate-like base fin having the distal end of each of the plurality of plate-like side fins directly coupled thereto.

16. The sporting apparatus training aid according to claim 10, wherein:

the upper surface of the plate-like base fin extends a length from the outer surface of central wall at least substantially equal to a radial length of the plurality of plate-like side fins.

17. In combination with a handheld sporting apparatus having an elongated shaft for gripping by a user and defining a longitudinal axis and a longitudinal plane oriented in a shaft direction and through a centroid on the longitudinal axis, wherein the improvement comprises:

a unitary body coupled to the sporting apparatus and having a proximal end, a distal end opposing the proximal end, a body length separating the proximal and distal ends, a central wall having an inner surface, an outer surface opposing the inner surface of the central wall, having at least one plate-like, side fin radially extending outwardly from the outer surface of the central wall, with a proximal end, a distal end opposite the proximal end of the at least one plate-like side fin, and opposing side surfaces defining outer side-tin planes oriented in the shaft direction, and having a plate-like base fin with a lower surface and an upper surface opposite the lower surface of the plate-like base fin, the upper surface of the plate-like base fin having the distal end of the at least one plate-like side fin directly coupled thereto and with the upper surface of the plate-like base fin oriented at an obtuse angle with respect to the outer surface of central wall, the at least one plate-like side fin and the plate-like side fin and plate-like base fin.

18. The improvement according to claim 17, wherein:

the unitary body is selectively removably coupled to the sporting apparatus.

19. The improvement according to claim 17, wherein:

the upper surface of the plate-like base fin defines a base-fin plane traversing each of the outer side-fin planes, the upper surface of the plate-like base fin extending a length from the outer surface of central wall at least substantially equal to a radial length of the at least one plate-like side fin, the lower surface of the plate-like base fin defining the distal end of the body.

20. The improvement according to claim 19, wherein the body further comprises:

a plurality of plate-like side fins radially extending outwardly from the outer surface of the central wall, the plate-like base fin interposed between each of the plurality of plate-like side fins.

* * * * *